US008350646B2

(12) United States Patent
Tan

(10) Patent No.: US 8,350,646 B2
(45) Date of Patent: Jan. 8, 2013

(54) CONNECTION STRUCTURE OF THE ARMATURE AND THE PUSHING MECHANISM OF THE RELAY

(75) Inventor: Zhonghua Tan, Xiamen (CN)

(73) Assignee: Xiamen Hongfa Electroacoustic Co., Ltd., Xiamen (CN)

( * ) Notice: Subject to any disclaimer, the term of this patent is extended or adjusted under 35 U.S.C. 154(b) by 0 days.

(21) Appl. No.: 13/503,776

(22) PCT Filed: Mar. 9, 2010

(86) PCT No.: PCT/CN2010/070938

§ 371 (c)(1),
(2), (4) Date: Apr. 24, 2012

(87) PCT Pub. No.: WO2011/072504

PCT Pub. Date: Jun. 23, 2011

(65) Prior Publication Data

US 2012/0206223 A1 Aug. 16, 2012

(30) Foreign Application Priority Data

Dec. 17, 2009 (CN) ..... 2009 1 0263852

(51) Int. Cl.
*H01H 51/22* (2006.01)
*H01H 67/02* (2006.01)

(52) U.S. Cl. ..... 335/129; 335/78

(58) Field of Classification Search ..... 335/129, 335/130, 78, 185
See application file for complete search history.

(56) References Cited

U.S. PATENT DOCUMENTS

| | | | | |
|---|---|---|---|---|
| 4,761,627 | A | 8/1988 | Bell | |
| 6,940,375 | B2 * | 9/2005 | Sanada et al. | 335/86 |
| 6,995,639 | B2 * | 2/2006 | Minowa et al. | 335/83 |
| 7,205,870 | B2 * | 4/2007 | Sanada et al. | 335/78 |
| 8,111,117 | B2 * | 2/2012 | Minowa et al. | 335/78 |
| 2003/0016104 | A1 * | 1/2003 | Mader et al. | 335/129 |
| 2004/0246080 | A1 * | 12/2004 | Tanaka et al. | 335/128 |
| 2005/0242907 | A1 * | 11/2005 | Minowa et al. | 335/129 |

FOREIGN PATENT DOCUMENTS

| | | |
|---|---|---|
| CN | 2383205 | 6/2000 |
| CN | 2708487 | 7/2005 |
| EP | 1672660 A2 | 6/2006 |
| EP | 1973134 A2 | 9/2008 |

* cited by examiner

*Primary Examiner* — Alexander Talpalatski
(74) *Attorney, Agent, or Firm* — Rabin & Berdo, P.C.

(57) ABSTRACT

A connection structure of an armature and a pushing mechanism of a relay has an armature and a pushing block. The head of the armature is T-shaped and connected by a vertical arm and a cross arm. One end of the pushing block has a bar-shaped through hole and a bar-shaped blind hole, disposed alongside and vertical to the motion direction of the pushing block. A through groove to connect the bar-shaped trough hole and the blind hole is disposed at the centre of the bar-shaped through hole and the blind hole. With the through groove, the T-shaped armature head can move along the through groove when the T-shaped armature head is shoved into the bar-shaped through hole. The cross arm of the T-shaped armature head is dropped into the bar-shaped blind hole to cooperate with the bar-shaped blind hole to drive the pushing block when the armature swings.

7 Claims, 8 Drawing Sheets

CONNECTION STRUCTURE OF THE ARMATURE AND THE PUSHING MECHANISM OF THE RELAY

FIELD OF THE INVENTION

The present invention relates to an electromagnetic relay, especially to the connection structure of the armature and the pushing mechanism of the relay.

BACKGROUND OF THE INVENTION

The existing electromagnetic relay usually includes a contact block, a magnetic system and a pushing block. The contact block includes a normally-closed fixed contact piece assembly, a normally-open fixed contact piece assembly and a movable contact piece assembly. These assemblies are disposed into the base in cartridge inserted way, forming a stable and reliable contact block. The magnetic system includes a yoke, an armature, a bobbin and a coil winding. The contact block and the magnetic system are assembled into the base to integrate into a relay. In the above structure of relay, the motion of the armature is passed to the movable contact piece through the pushing block. One end of the pushing block is assembled in stuck way to form pin joint with the armature head. The armature and the pushing block can rotate relatively in a certain angle range with the pin joint, which is served as the axis. The other end of the pushing block disposed with a bump is shoved into the notch of the movable contact piece in lap joint way. When the coil of the relay isn't energized, the normally-closed fixed contact set retains connected, the pushing block and the movable contact piece is in free lap joint. When the coil of the relay is energized, the armature moves toward the yoke, the pin joint portion drives the pushing block move, the pushing block pass the motion of the armature to the movable contact piece, the movable contact piece moves to cut off the normally-closed fixed contact set and connect the open static contact. With the electromagnetic force of the powered coil, it maintains that the closed static contact is cut off and the normally-open fixed contact set is connected.

FIG. 1 illustrates the integrated structure of the existing relay; FIG. 2 illustrates the breakdown structure of the existing relay; FIG. 3 illustrates the assembly structure of the armature and the pushing block of the existing relay; FIG. 4 illustrates the assembly process of the armature and the pushing block of the existing relay.

The structure of the relay includes a base 1', a pushing block 2', an armature3', a yoke 4', a bobbin 5', a coil 6', a normally-closed contact set 7', a normally-open contact set 8' and a movable contact piece 9'; a bump 31' and a convex bract 32' are disposed on the head of the armature 3'; a hole 21' and a concave stage 22' are disposed in one end of the pushing block 2'; the thickness of the bump 31' on the head of the armature 3' is less than the width of the hole 21' of the pushing block. However, the thickness of the concave bract 32' on the head of the yoke 3' is more than the width of the hole 21' of the pushing block. When the armature 3' and the pushing block 2' are assembled, the bump 31' on the head of the armature 3' is shoved into the hole 21' of the pushing block with the convex bract 32' is interferencefit assembled.

After assembly, the concave stage 22' of the pushing block is served to limit the convex bract 32' of the armature head. Without external force, the armature 3' can not be divorced away from the hole 21' of the pushing block. As the thickness of the bump 31' of the armature head is less than the width of the hole 21' of the pushing block, the armature 3' can rotate in an certain angle range. This is the pin joint of the armature 3' and the pushing block 2'. When the armature 3' moves forwards or backwards, the yoke 3' drives the pushing block move forwards or backwards. Then the pushing block 2' drives the movable contact piece move for contact switch.

However, in the assembly process of the structure of the relay, as the assembly of the armature 3' and the pushing block 2' is interferencefit, the assembly is building with plastic waste, which will cause the contact unusable and the dysfunction of the relay. Besides, the interferencefit construre makes the pushing block 2' disassembled with damaged when the armature 3' is assembled to the pushing block 2'.

SUMMARY OF THE INVENTION

The object of the invention is to overcome the disadvantages of the existing technology, provided with a connection structure of the armature and the pushing mechanism of the relay. Based on the premise of better realization of the armature driving the pushing block move, this structure makes the assembly and disassembly of the armature and the pushing block easily. The assembly is building without plastic waste. The present invention is provided with simply structure, low cost and suitable for mass production.

The technical proposal of the present invention is:

A connection structure of the armature and the pushing mechanism of the relay includes an armature and a pushing block; the head of the armature is T shaped and formed from the connection of a vertical arm and a cross arm; one end of the pushing block is disposed with a bar shaped through hole to let the T shaped structure of the head of the armature pass through and a bar shaped blind hole to let the cross arm of the T shaped structure of the head of the armature to drop in; the bar shaped through hole and the bar shaped blind hole are disposed alongside and vertical to the motion direction of the pushing block; a through groove is disposed at the central between the bar shaped through hole and the bar shaped blind hole; with the through groove, the T shaped head of the armature is moved along the through groove when passing through the bar shaped through hole, and the cross arm of the T shaped is dropped into the bar shaped blind hole to cooperate with the bar shaped blind hole to push the pushing block move when the armature swings.

One end of the cross arm is disposed with a first pushing face to cooperate with one side wall of the bar shaped blind hole to push the pushing block to move in a direction, the other end of the cross arm is disposed with a second pushing face to cooperate with the other end wall of the bar shaped blind hole to push the pushing block to move in the opposite direction.

The peripheral size of the cross arm is metalfit with the hole size of the bar shaped through hole.

The width of the vertical arm is metalfit with the width of the through groove.

The beneficial effect of the present invention is:

The armature head is T shaped connected by a cross arm and a vertical arm. One end of the pushing block is disposed with a bar shaped through hole, a bar shaped blind hole and a through groove, and the through groove is disposed between the bar shaped through hole and the bar shaped blind hole.

The T shaped armature head can be shoved from the bar shaped through hole of the pushing block. When the vertical arm of the T shaped armature head passes through the through groove, the cross arm of the T shaped armature head can be dropped into the bar shaped blind hole of the pushing block. When the armature of the relay moves forwards, the head end of the cross arm of the armature drives the pushing block move forwards. The pushing block drives the movable contact piece move forwards as well, realizing the connection of the movable contact and the normally- open fixed contact. Then the pushing block is pressing on the movable contact piece to maintain the connection of the contacts. When the armature of the relay moves backwards, the rear of the cross arm of the armature pulls the pushing block to move backwards. The pushing block drives the movable contact piece move backwards as well, realizing the connection of the movable contact and the normally-closed fixed contact. The pushing block holds on the movable contact piece to maintain the connection of the contacts.

Based on the premise of better realization of the armature driving the pushing block move, the connection of the armature and the pushing block is metalfit without assembly by force. The assembly is building without plastic waste, preventing bad factors of causing failure of the relay. The pushing block taken away during producing is reusable without damage. This can reduce cost. The present invention is provided with simply structure, low cost and suitable for mass production.

The present invention is further described with the drawings and the embodiments, but not limited by the embodiments.

DETAILED DESCRIPTION OF THE EMBODIMENT

Embodiment

Figure 1:
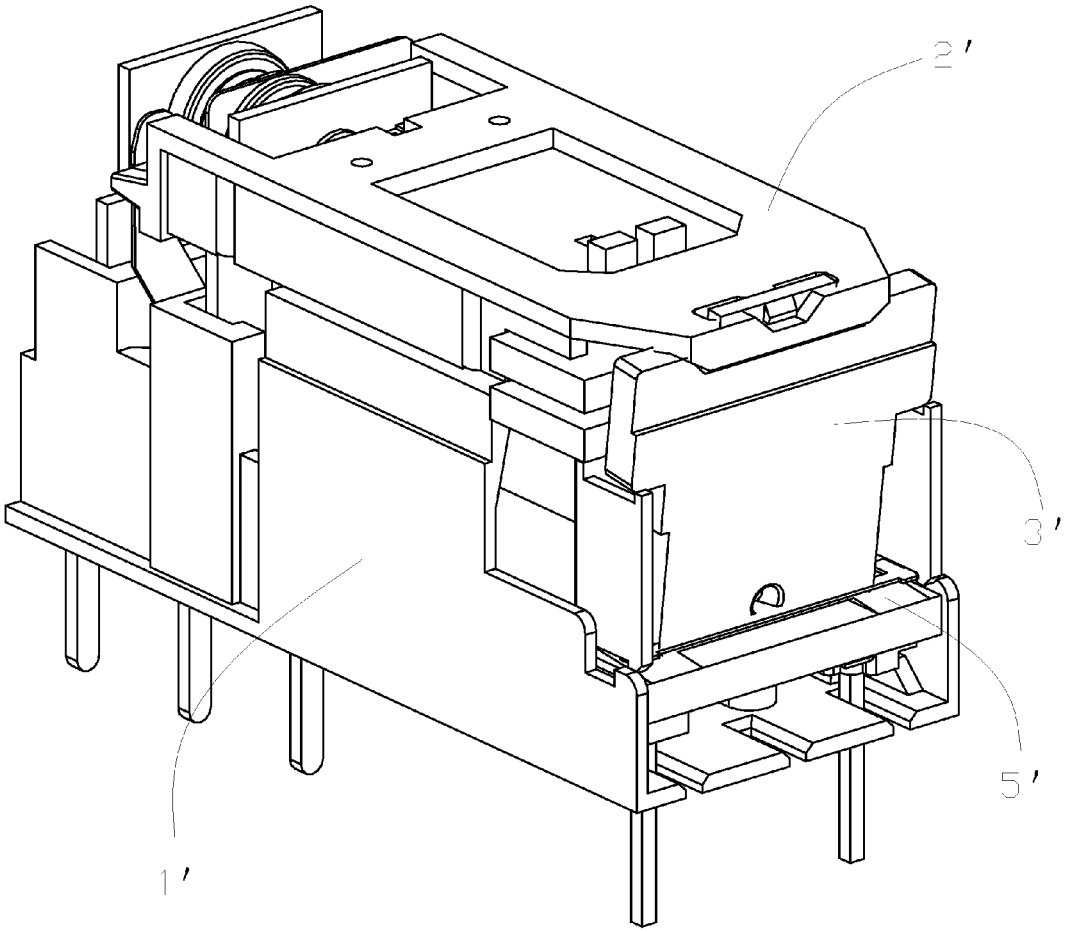
FIG. 1 Prior Art
FIG. 1 illustrates the structure of the existing relay.
Figure 2:
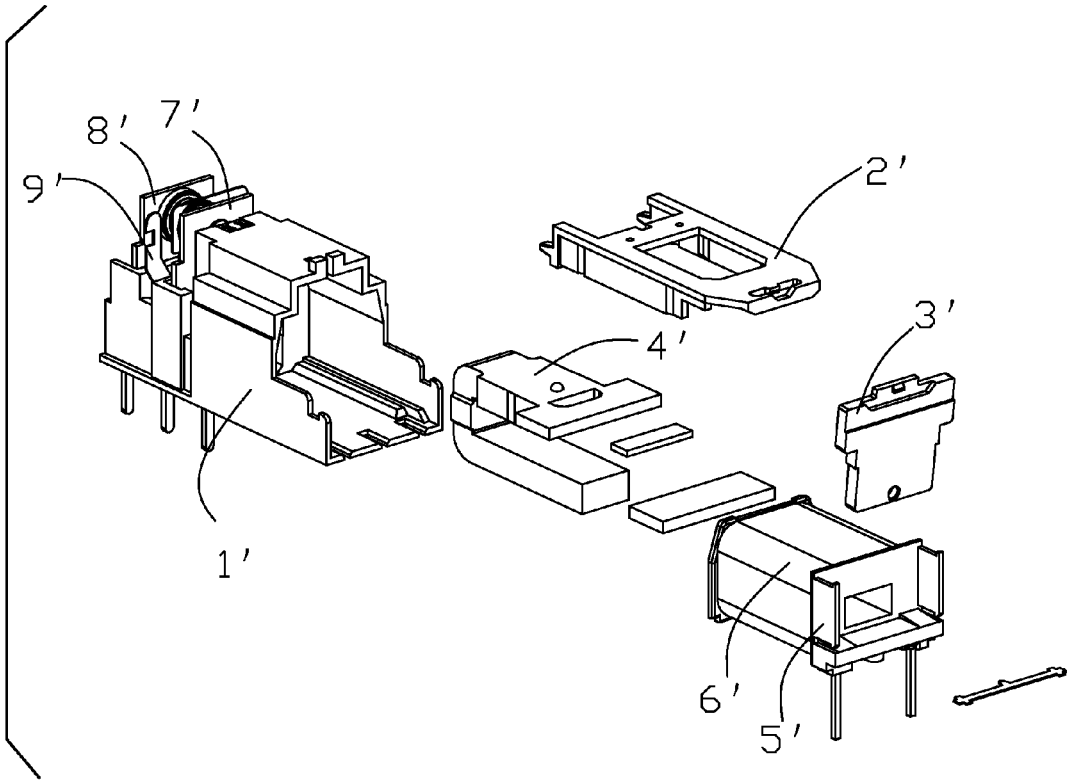
FIG. 2 Prior Art
FIG. 2 illustrates the breakdown structure of the existing relay.
Figure 3:
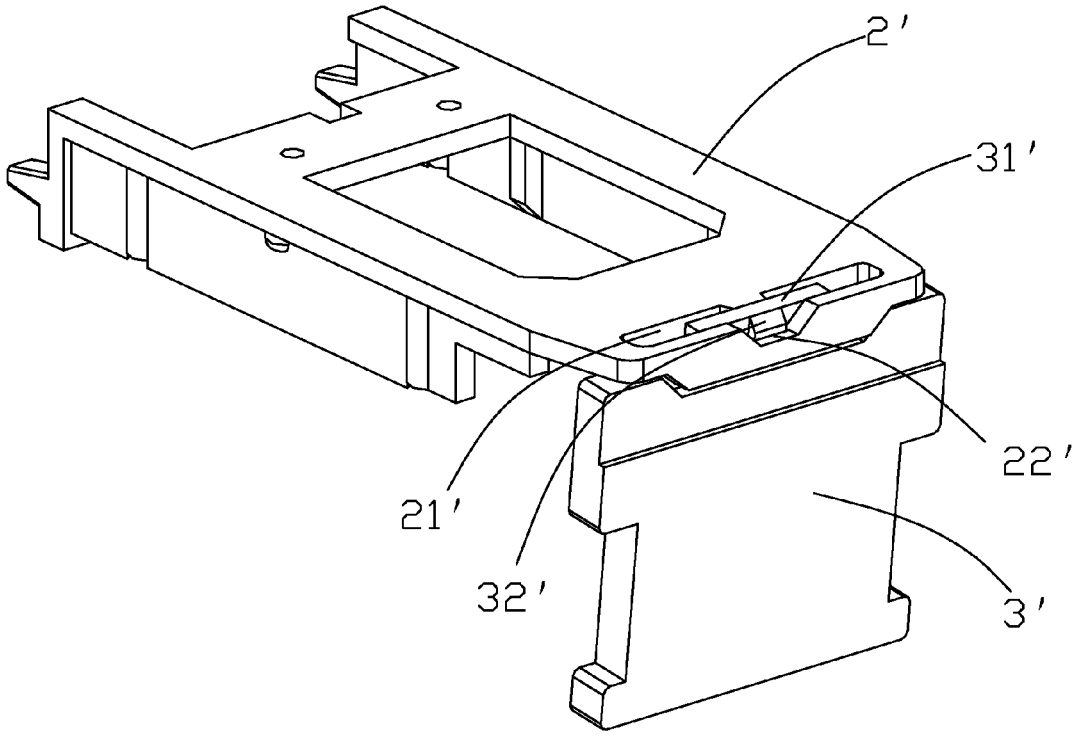
FIG. 3 Prior Art
FIG. 3 illustrates the structure of the assembly of the armature and the pushing block of the existing relay.
Figure 4:
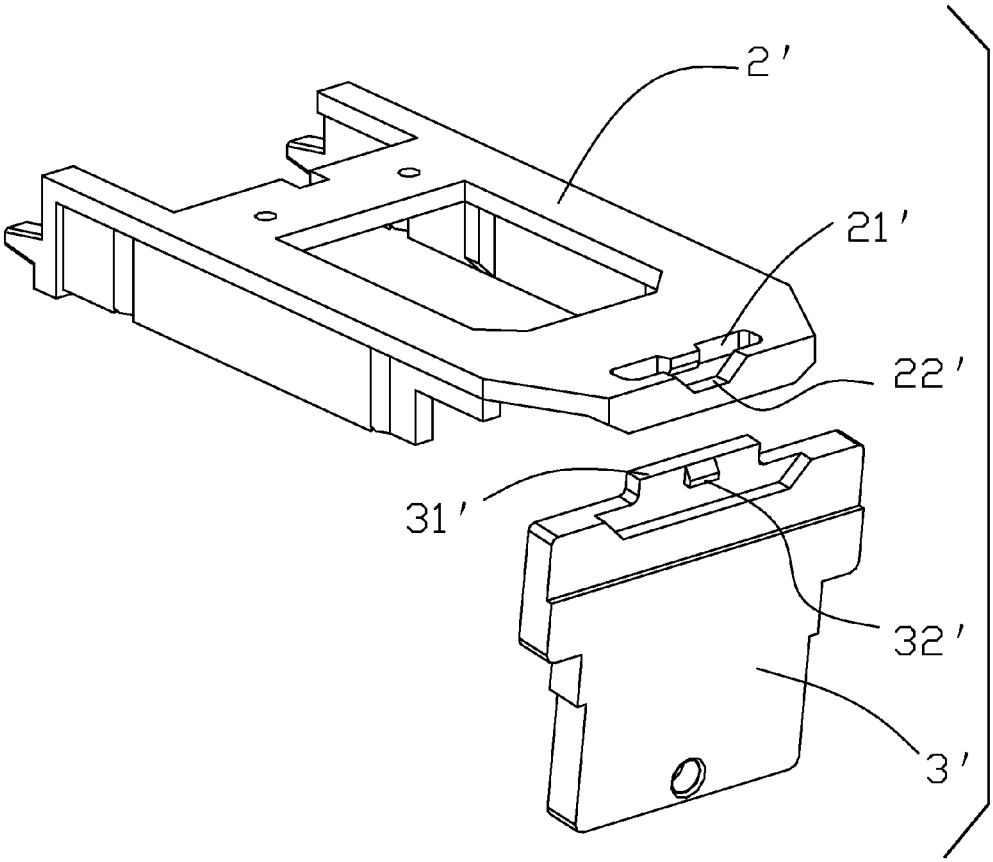
FIG. 4 Prior Art
FIG. 4 illustrates the assembly process of the armature and the pushing block of the existing relay.
Figure 5:
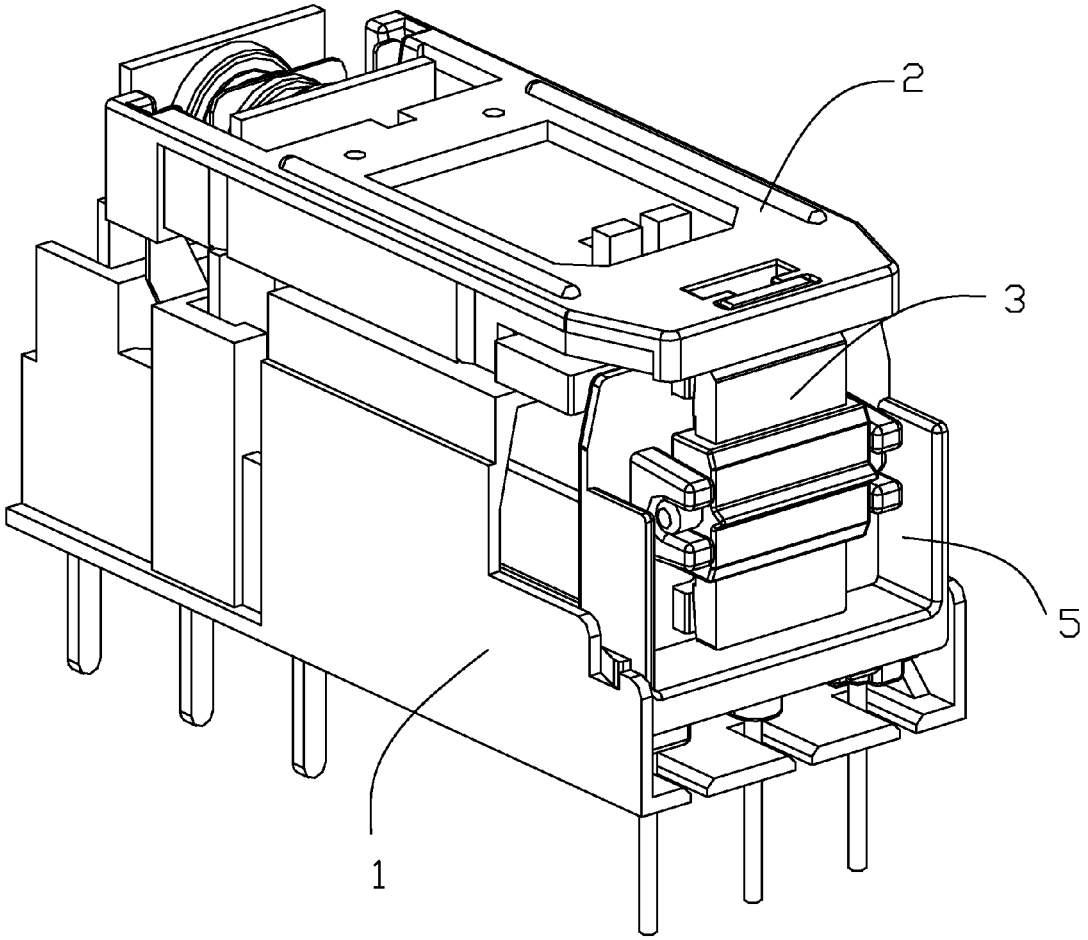
FIG. 5 illustrates the integrated structure of the embodiment in the present invention.
Figure 6:
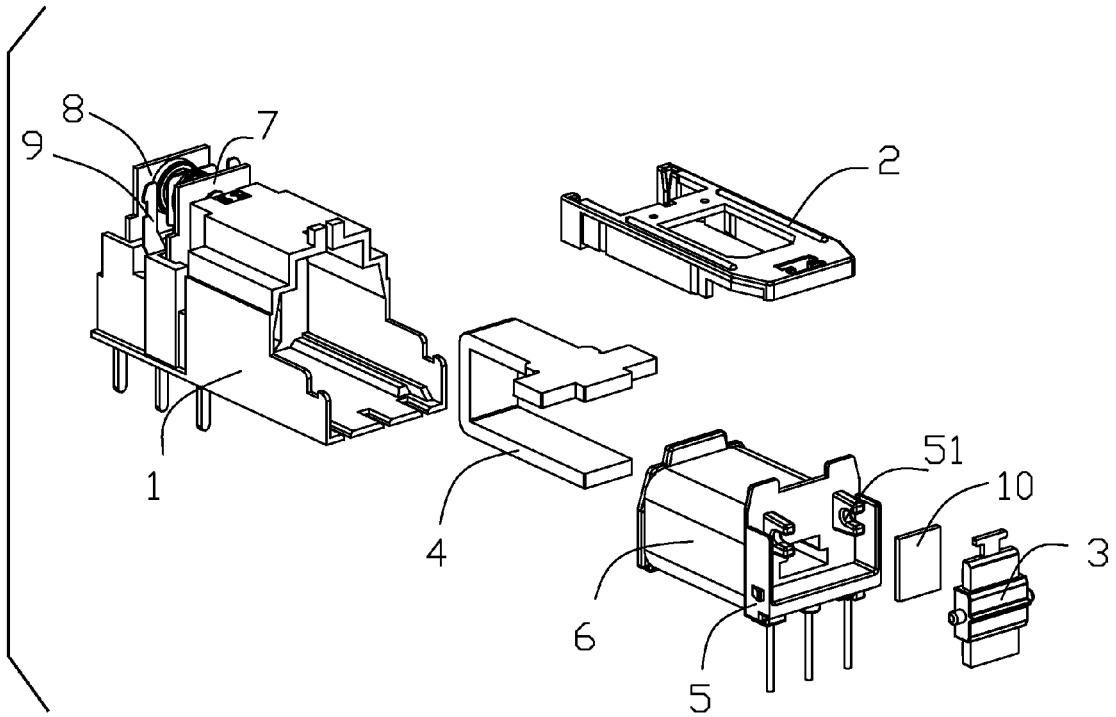
FIG. 6 illustrates the breakdown structure of the embodiment in the present invention.
Figure 7:
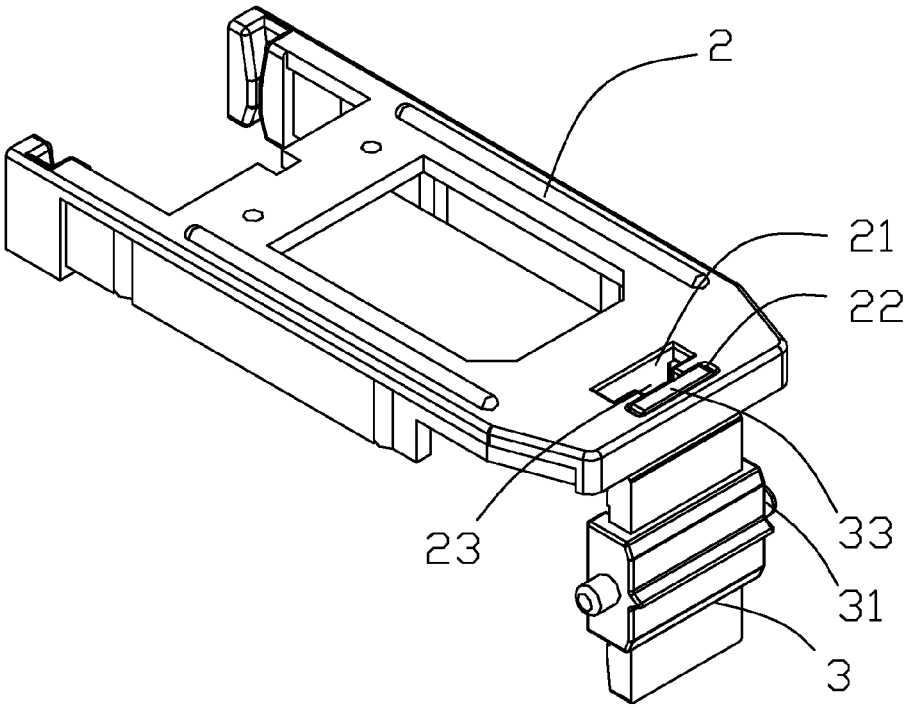
FIG. 7 illustrates the assembly of the armature and the pushing block of the embodiment in the present invention.
Figure 8:
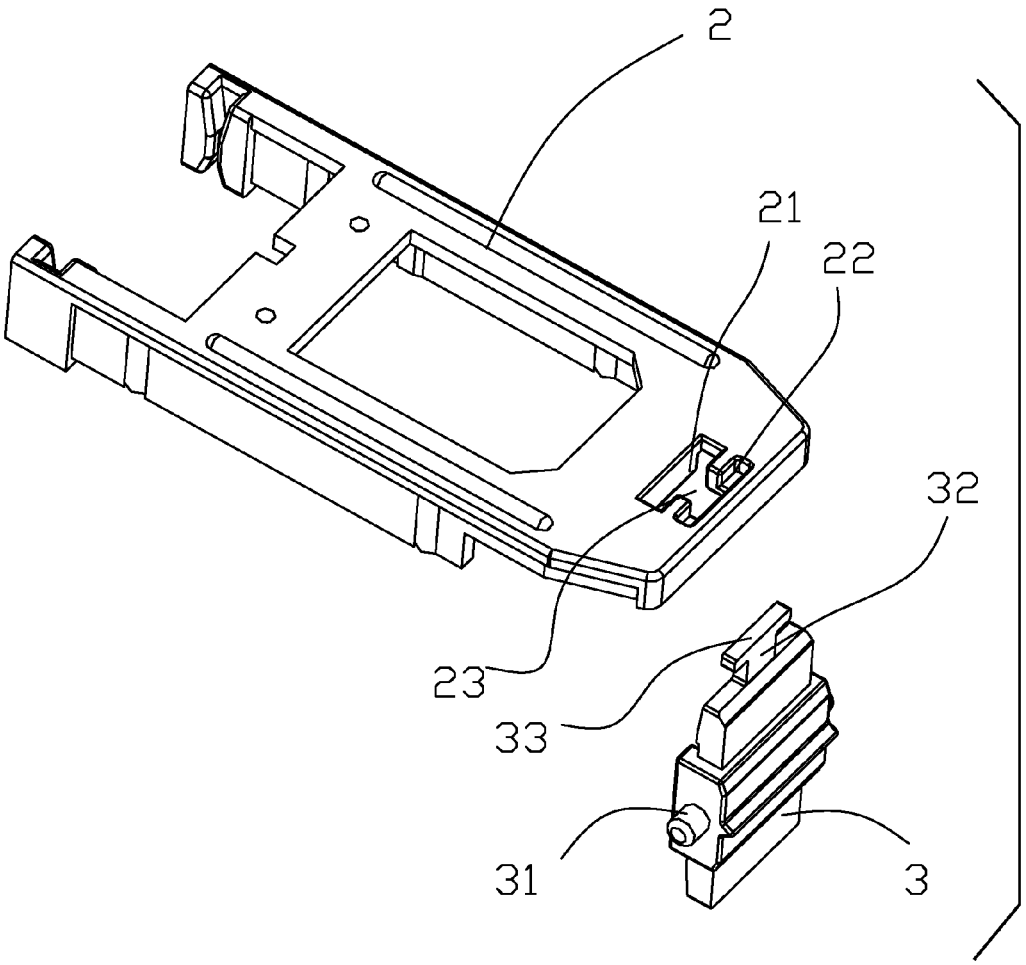
FIG. 8 illustrates the assembly process of the armature and the pushing block of the embedment in the present invention.

As figured in the FIG. 5 to the FIG. 8, the connection structure of the armature and the pushing mechanism of the relay in the present invention can be applied for the magnetic latching relay. It can be used in other relays as well. The relay includes a contact block, a magnetic system, a base 1 and a pushing block 2. The contact block includes a normally-closed contact set 7, a normally-open contact set 8 and a movable contact piece 9. These assemblies are fixed inside the guide groove of the base 1 in the cartridge inserted way, forming a stable and reliable contact block. The magnetic circuit part includes a yoke 4, an armature 3, a magnet 10, a bobbin 5 and a coil winding 6. The yoke 4 is U shaped; one end of the yoke 4 is passed through the hole of the bobbin 5 to be placed inside the coil winding 6. The other end of the yoke 4 is placed outside the bobbin 5 and outside the coil winding 6 as well. A groove 51 is disposed on the surface of the sideboard of the bobbin 5, which is placed in the opening of the yoke, to support the rotation of the armature. The armature 3 is seesaw shaped with limited stage to hold and fix the magnet. The armature has an axis 31 to support itself partially rotate. Put the axis 31 into the groove 51 of the sideboard of the bobbin, the armature 3 is positioned in the cooperation location.

The head of the armature 3 is T shaped, with a vertical arm 32 and a cross arm 33 connected together. One end of the pushing block 2 is disposed with a bar shaped through hole 21 to let the T shaped head of the armature pass through and a bar shaped blind hole 22 to let the cross arm 33 of the T shaped head of the armature drop in. the bar shaped through hole 21 and the bar shaped blind hole 22 are disposed alongside and vertical to the motion direction of the pushing block 2; a through groove23 is disposed at the central between the bar shaped through hole and the bar shaped blind hole; with the through groove, the T shaped head of the armature is moved along the through groove when passing through the bar shaped through hole 21, and the cross arm 33 of the T shaped is dropped into the bar shaped blind hole to cooperate with the bar shaped blind hole to push the pushing block move when the armature swings.

Thereinto:

One side of the cross arm 33 is disposed with a first pushing face to cooperate with one side wall of the bar shaped blind hole to drive the pushing block move in a direction; the other side of the cross arm 33 is disposed with a second pushing face to cooperate with the other side wall of the bar shaped blind hole to drive the pushing block move in the opposite direction.

The peripheral size of the cross arm 33 is metalfit to the hole size of the bar shaped through hole 21.

The width of the vertical arm 32 is metalfit to the width of the through groove 23.

The thickness of the cross arm 33 is less than the depth of the bar shaped blind hole 22.

The width of the cross arm 33 is less than the width of the bar shaped blind hole 22, forming a demising interval for the swinging of the armature.

The connection structure of the armature and the pushing mechanism of the relay can be applied for kinds of relay, such as latching relay or hinge type relay and so on. The armature head is T shaped; one end of the pushing block is disposed with a bar shaped through hole 21, a bar shaped blind hole 22 and a through groove 23. The through groove 23 is connected with a bar shaped through hole 21 and the bar shaped blind hole 22. The T shaped armature 3 head can be shoved from the bar shaped through hole 21 in one end of the pushing block 2. the vertical arm 32 of the T shaped armature 3 head is passed through the through groove 23 to make the cross arm 33 of the T shaped head drop in the bar shaped blind hole 22 of the pushing block to cooperate with the bar shaped blind hole to drive the pushing block 2 move when the armature 3 swings. When the armature 3 of the relay moves forwards, the head end of the cross arm 33 of the armature drives the pushing block 2 move forwards. The pushing block 2 drives the movable contact piece 9 move forwards as well, realizing the connection of the movable contact and the normally- open fixed contact. Then the pushing block 2 is pressed on the movable contact piece 9 to maintain the connection of the contacts. When the armature 3 of the relay moves backwards, the rear of the cross arm 33 of the armature pulls the pushing block 2 to move backwards. The pushing block 2 drives the movable contact piece 9 move backwards as well, realizing the connection of the movable contact and the normally-open fixed contact. The pushing block 2 holds on the movable contact piece 9 to maintain the connection of the contacts. When raise up the cross arm 33 of the armature away from the bar shaped blind hole 22 of the pushing block, the cross arm 32 of the T shaped armature head moves along the through groove 23 of the pushing block, making the T shaped armature head reaches to the bar shaped through hole 21. The cross arm 33 of the T shaped armature head can be taken out of the bar shaped through hole 21 with convenience. That is the opposite direction of the assembly direction to take the cross arm 33 of the T shaped armature head from the place with the pushing block for the regulation of the mechanical parameter of the relay.

The T shaped head of the armature of present invention can be a convert L shaped connected by a vertical arm 32 and a cross arm 33. Correspondingly, one end of the pushing block is disposed with a bar shaped through hole 21, a bar shaped blind hole 22 and a through groove 23 to couple with the convert L shaped armature head. The through groove 23 is connected between the bar shaped through hole 21 and the bar shaped blind hole 22.

The section of the vertical arm 32 and the cross arm 33 of the armature head can be circle or square.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

Industrial Applicability

The present invention is provide with a connection structure of the armature and the pushing mechanism of the relay, which includes an armature and a pushing block; the armature head is T shaped and connected by a vertical arm and a cross arm. One end of the pushing block is disposed with a bar shaped through hole, a bar shaped blind hole and a through groove connected the prefer two. This structure makes the assembly and disassembly of the armature and the pushing block easily. The assembly is building without plastic waste. The present invention is provided with simply structure, low cost and suitable for mass production.

What is claimed is:

1. A connection structure of a relay, comprising:

an armature having a head that is T shaped and formed from a vertical arm connected to a cross arm;

a pushing block having one end provided with a bar shaped through hole to let the T shaped structure of the head of the armature pass through, and a bar shaped blind hole to let the cross arm to drop in, the bar shaped through hole and the bar shaped blind hole being disposed alongside and vertical to a motion direction of the pushing block, a through groove being disposed centrally between the bar shaped through hole and the bar shaped blind hole, the T shaped head of the armature being moved along the through groove when passing through the bar shaped through hole, and the cross arm being dropped into the bar shaped blind hole to cooperate with the bar shaped blind hole to push the pushing block to move when the armature swings.

2. The connection structure according to the claim 1, wherein one end of the cross arm is provided with a first pushing face to cooperate with one side wall of the bar shaped blind hole to push the pushing block to move in a first direction, the other end of the cross arm is provided with a second pushing face to cooperate with the other end wall of the bar shaped blind hole to push the pushing block to move in an opposite second direction.

3. The connection structure according to the claim 1, wherein a peripheral size of the cross arm is a loose fit relative to a hole size of the bar shaped through hole.

4. The connection structure according to the claim 1, wherein a width of the vertical arm is a loose fit relative to a width of the through groove.

5. The connection structure according to the claim 1, wherein a thickness of the cross arm is less than or equal to a depth of the bar shaped blind hole.

6. The connection structure according to the claim 1, wherein a width of the cross arm is less than that of the bar shaped blind hole, to allow for the swinging of the armature.

7. The connection structure according to the claim 1, wherein an axis disposed on the armature to rotatably support the armature.

* * * * *